US012397977B2

(12) United States Patent
Ashton

(10) Patent No.: US 12,397,977 B2
(45) **Date of Patent: *Aug. 26, 2025**

(54) DUAL-PURPOSE CONTAINER CLOSURE

(71) Applicant: Jason Ashton, Watsonville, CA (US)

(72) Inventor: Jason Ashton, Watsonville, CA (US)

( * ) Notice: Subject to any disclaimer, the term of this patent is extended or adjusted under 35 U.S.C. 154(b) by 37 days.

This patent is subject to a terminal disclaimer.

(21) Appl. No.: 18/149,499

(22) Filed: Jan. 3, 2023

(65) Prior Publication Data

US 2023/0150738 A1 May 18, 2023

Related U.S. Application Data

(60) Continuation-in-part of application No. 17/196,625, filed on Mar. 9, 2021, now Pat. No. 11,542,077, which is a division of application No. 16/797,665, filed on Feb. 21, 2020, now Pat. No. 10,974,881.

(51) Int. Cl.

| | |
|---|---|
| ***B65D 51/28*** | (2006.01) |
| ***A24F 13/12*** | (2006.01) |
| ***A24F 15/01*** | (2020.01) |
| ***B65D 25/04*** | (2006.01) |
| ***B65D 43/02*** | (2006.01) |
| ***B65D 47/06*** | (2006.01) |
| ***B65D 51/16*** | (2006.01) |

(52) U.S. Cl.

CPC ..... *B65D 51/28* (2013.01); *A24F 13/12* (2013.01); *A24F 15/01* (2020.01); *B65D 25/04* (2013.01); *B65D 43/0231* (2013.01); *B65D 47/065* (2013.01); *B65D 51/1633* (2013.01)

(58) Field of Classification Search

CPC ..... A24F 7/00; A24F 1/14; A24F 9/14; A24F 15/01; A24F 13/12; A24F 1/30; A24F 47/008; B65D 51/28; B65D 25/04; B65D 43/0231; B65D 47/065; B65D 51/1633; B65D 25/20; B65D 51/2807; A61M 2205/59; A45F 3/16; A62B 18/086; A47G 19/22

See application file for complete search history.

(56) References Cited

U.S. PATENT DOCUMENTS

2014/0102463 A1* 4/2014 Jones ..... A61M 15/06 131/329
2015/0342259 A1* 12/2015 Baker ..... A24F 40/485 131/329

* cited by examiner

*Primary Examiner* — Shawn M Braden
(74) *Attorney, Agent, or Firm* — Donald R. Boys; Central Coast Patent Agengy LLC

(57) ABSTRACT

A closure for a beverage container has a body having an attachment interface to engage to a top of a beverage container, a sealed, elongated enclosure attached to an underside of the body, and a single access element adapted to selectively open and close either a first opening passing through the body into the sealed, elongated enclosure or a second opening passing through the body directly to an inner volume of the beverage container.

8 Claims, 16 Drawing Sheets

DUAL-PURPOSE CONTAINER CLOSURE

CROSS-REFERENCE TO RELATED APPLICATIONS

The present invention is a continuation-in-part of co-pending application Ser. No. 17/196,625, filed Mar. 9, 2021, which is a divisional application of Ser. No. 16/797,665 filed Feb. 21, 2020, now issued as U.S. Pat. No. 10,974,881 on Apr. 13, 2021. All disclosure of the parent application is incorporated at least by reference.

BACKGROUND OF THE INVENTION

1. Field of the Invention

The present invention is in the technical area of apparatus and methods for smoking tobacco and other materials, and pertains more particularly to a container closure that enables a user to access a vapor pen enclosed in the container, or to ingest liquid from the container as well.

2. Description of Related Art

There exist in the conventional art a considerable variety of beverage containers, such as water and coffee containers, adapted for users to fill and refill, and to ingest liquid from the container as desired. There exist in the art as well a considerable variety of vapor pens and the like for users to draw flavored vapor and the like as desired. What is needed is a closure for existing beverage containers, the enclosure having apparatus with alternative draw elements, that allows drawing liquid, such as coffee or water from the container by one draw element, and allows drawing from an enclosed vapor-producing apparatus through a separate draw element.

BRIEF SUMMARY OF THE INVENTION

In an embodiment of the invention a closure for a beverage container is provided, comprising a body having an attachment interface to engage to a top of a beverage container, a sealed, elongated enclosure attached to an underside of the body, and a single access element adapted to selectively open and close either a first opening passing through the body into the sealed, elongated enclosure or a second opening passing through the body directly to an inner volume of the beverage container. In one embodiment the attachment interface of the body is a male thread matching a female thread at the top of the beverage container. Also, in one embodiment the single access element is an elongated element having a cylindrical portion at a first end and an extended portion from the cylindrical portion with a passage through a length of the element, the cylindrical portion pivoted at a center point of the cylinder between opposite sides of an elongated well on an upper region of the body, in a manner that with the access element in a first position lying in the elongated well with the cylindrical portion engaging a cylindrically shaped depression the access element seals a vent into both the beverage container and the sealed enclosure, with the access element rotated to a second position aligns the passage through the length of the access element with an opening through the body into the sealed enclosure and with the access element rotated to a third position aligns the passage through the length with an opening through the body into an inner volume of the beverage container.

In one embodiment the first opening passing through the body into the sealed elongated enclosure ends at a first interface under the body with a first tube engaged reaching proximate the lower end of the sealed elongated enclosure, and the second opening passing through the body ends at a second interface with a second tube engaged reaching proximate a bottom of the beverage container. Also, in one embodiment the first opening passing through the body into the sealed elongated enclosure ends at a first interface under the body with a flexible connector engaged to the first interface and to a vapor-producing apparatus and the second opening passing through the body ends at a second interface with a tube engaged reaching proximate a bottom of the beverage container.

In one embodiment the attachment interface of the body is a female thread matching a male thread at the top of the beverage container. In one embodiment the attachment interface of the body is a male thread matching a female thread at the top of the beverage container. And in one embodiment the access element has three spherical depressions on one side on a radial ring and a spring-loaded ball on a surface of an inside wall of the rectangular well, such that the ball engages the depressions as the access element rotates and positions the access element accurately at the first, the second and the third position.

DETAILED DESCRIPTION OF THE INVENTION

Figure 1:
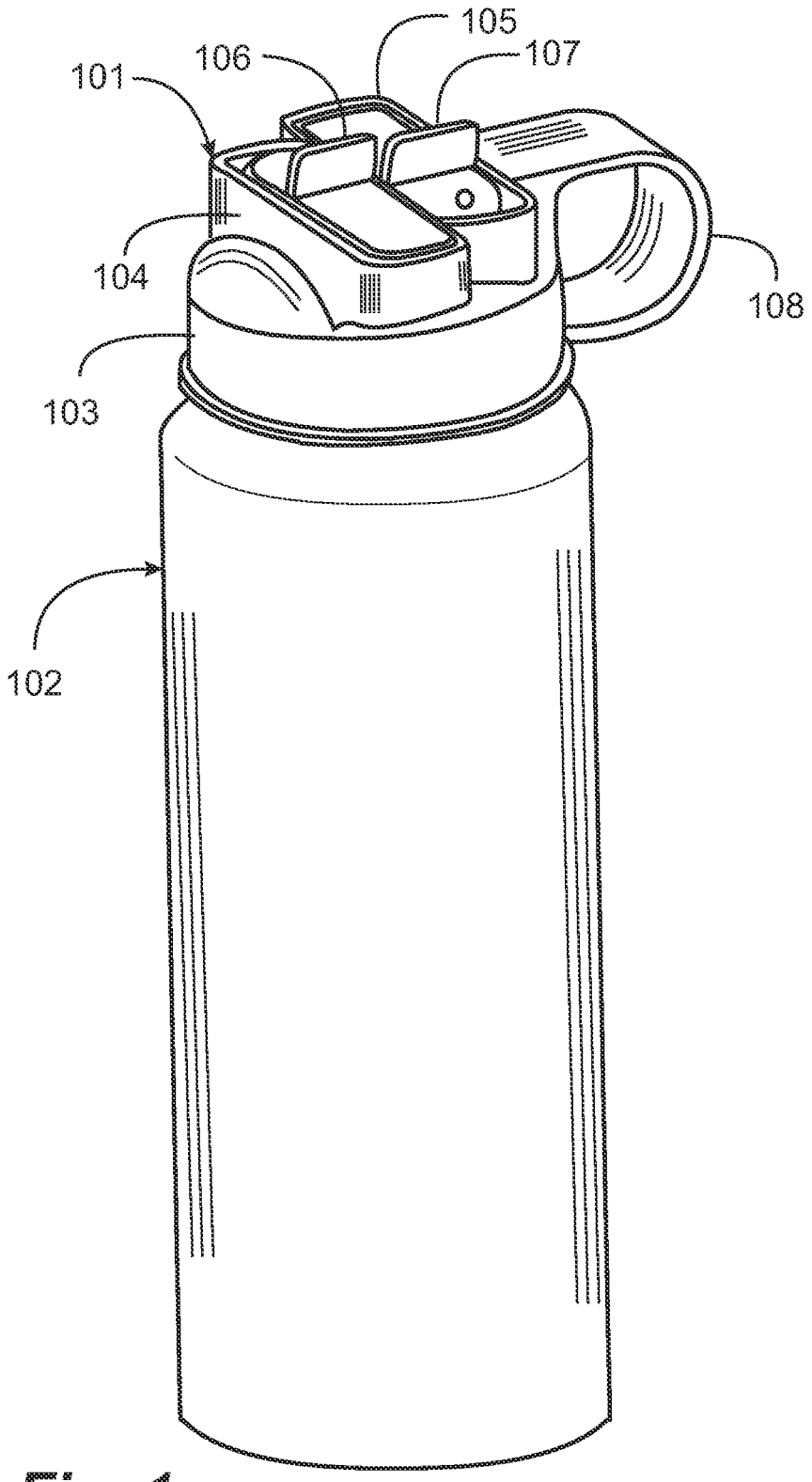
FIG. 1 is an elevation view of a container closure engaged to a container in an embodiment of the invention.

FIG. 1 is an elevation view of a container closure 101 engaged to a container 102 in an embodiment of the invention. The container may be any one of a variety of conventional beverage containers known in the art, such as, for example, an aluminum coffee container like many provided by coffee enterprises. Closure 101 in this embodiment of the invention comprises a body 103, which in this example has an internal female thread to engage a male threaded top of container 102. In alternative embodiment the closure may have a body with a male thread to engage a female threaded top of a container. In other embodiments the closure may have an interface to engage containers of other sorts, such as even paper cups and the like.

In the example shown in FIG. 1 closure 101 has two access wells 104 and 105. Access well 104 has a pivoted access element 106, that tipped up opens a path from a draw tip down through the closure into a second sealed enclosure within the outer enclosure of container 102. In this example a vapor-producing apparatus such as a vape pen is connected within the second sealed enclosure through access element 106, enabling a user to tip up element 106, and to draw vapor from the vapor-producing apparatus.

Access well 105 has a pivoted access element 107, similar in design and function to access element 106, that connects to a tubing under the closure, the tubing extending downward into any liquid, such as water or coffee, that may be carried in container 102. A user may tip up access element 107 and draw liquid through the tube and the access element as one would using a straw. There is a vent hole not shown that serves to equalize pressure. Finally, a handle 108 is provided on the closure to carry the closure and any added container.

Figure 2:
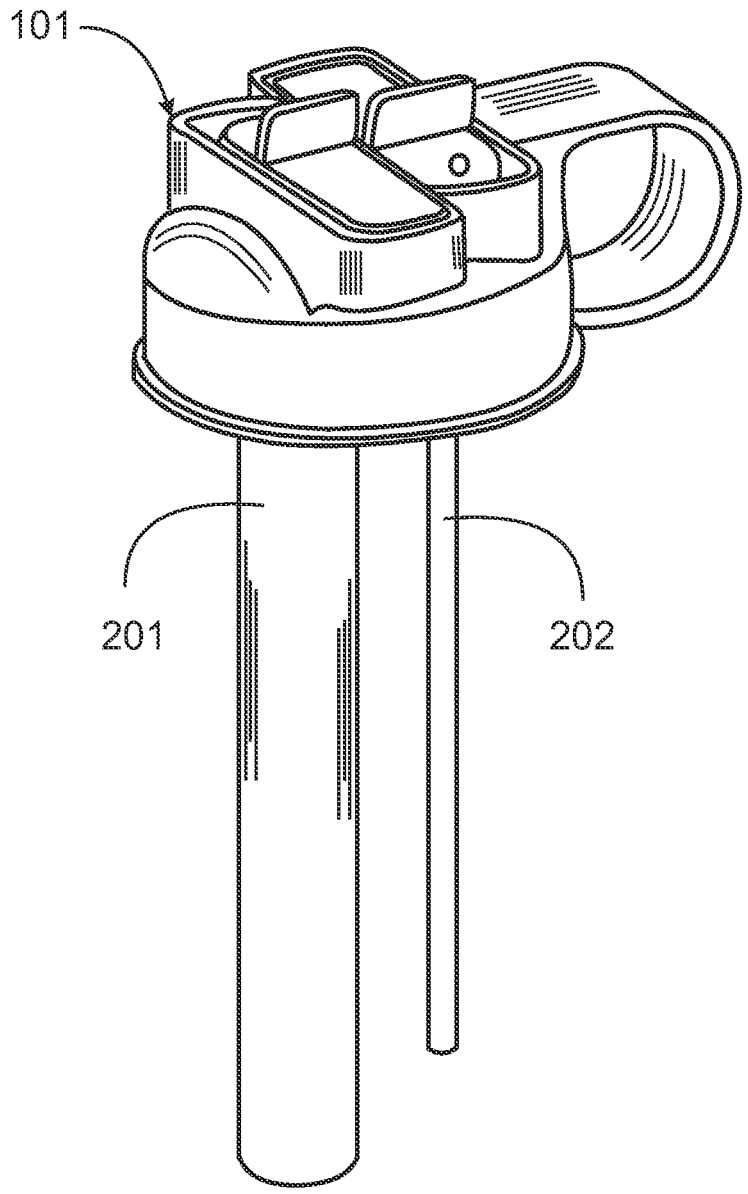
FIG. 2 illustrates the container closure of FIG. 1 removed from the container and showing an inner sealed enclosure.

FIG. 2 illustrates closure 101 removed from container 102, showing the second inner sealed enclosure 201, that may enclose, for example, a vapor-producing apparatus, and also a tubing 202 that extends downward, and may extend into any liquid that may be carried in a container like container 102. It should be noted that enclosure 201 is completely enclosed and sealed from liquid that may be in container 102, while tube 202 is open to the liquid, and extends downward into the liquid, which may be water, coffee or any other beverage. Tube 202 may be fashioned of a suitable polymer material.

Figure 3:
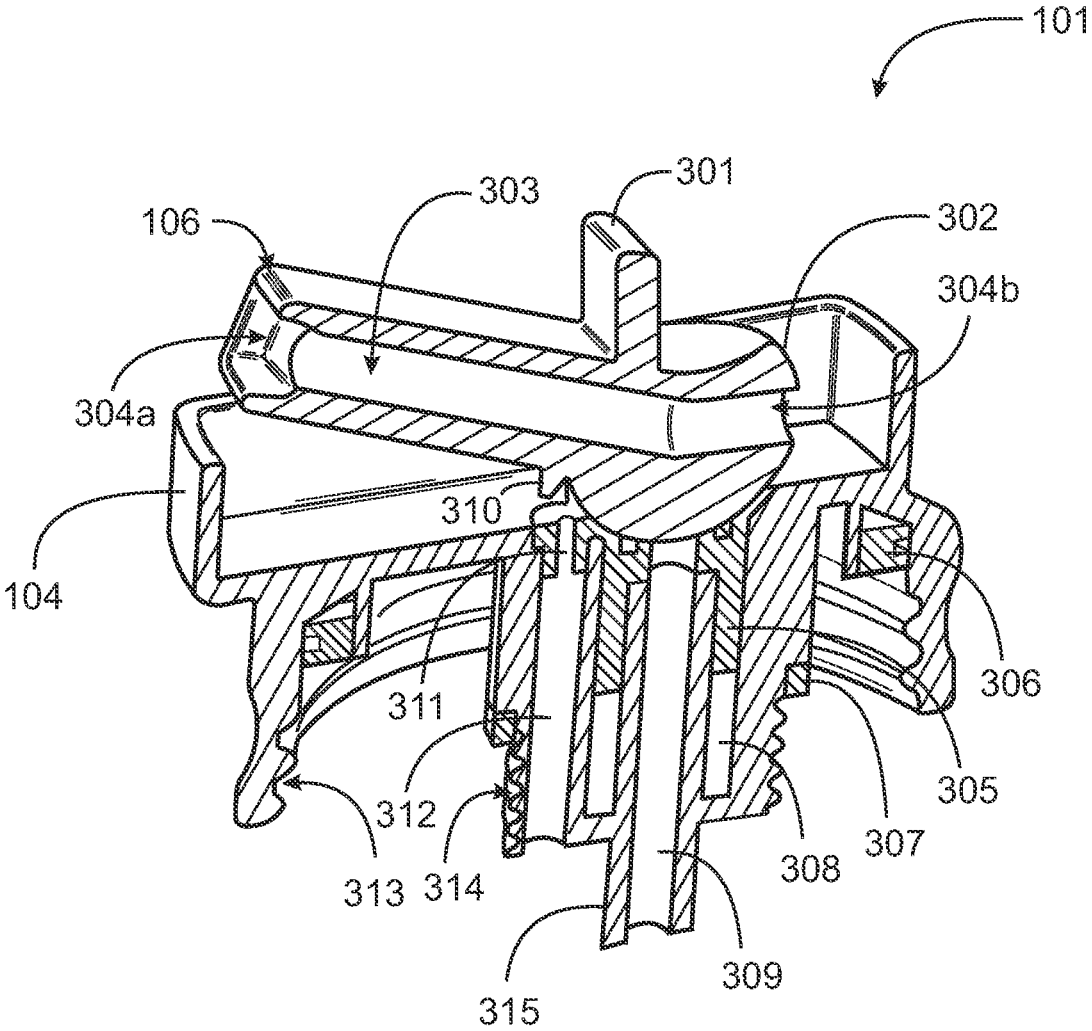
FIG. 3 is a partial section view through the closure of FIG. 1.

FIG. 3 is a partial section view through closure 101, taken along a centerline of well 104 and access element 106. It may be seen in this section that well 104 is a rectangular enclosure with an open top. Access element 106 is an elongated unit of a width to fit into the width of well 104. There is a passage 303 through the length of element 106, with an opening 304*a* on one end and an opening 304*b* on the other. The end of element 106 with opening 304*b* has a spherical shape and opening 304*b* opens through this spherical shape. Access element 106 is pivoted across well 104 along an axis at the center of the spherical shape, such that a user may use tip 301 to rotate the access element around the pivot access to a stop point where opening 304*b* aligns with a vertical passage 309 through closure 101.

A seal element 305 locates in a passage 308 and has a concave spherical shape facing upward into well 104, and the spherical shape 302 of access element 106 rests in and rotates against seal element 305. At the rotation stop point that opening 304*b* aligns with vertical passage 309, a user may place lips on the end of element 106 with opening 304*b*, and may draw on the volume into which vertical passage 308 opens below closure 101.

In addition to access to passage 309 through the passage 303 through access element 106, there is a small vent hole 311 vertically through seal element 305, and this hole communicates with a passage 312 into the volume below closure 101. A small tip 310 on the underside of access element 106 closes hole 311 when the access element is rotated to be fully within well 104. Passage 309 leads to and through a cylindrical nib 315.

A male threaded portion 314 on a lower portion of closure 101 provides for engagement of an elongated enclosure 201 (see FIG. 2) by a female thread on the top of enclosure 201. There is also a gasket 307 against which enclosure 201 seats when fully engaged by threaded portion 314. Internal female threads 313 are to engage with external male threads at the top of beverage container 102, and a gasket 306 engages a top rim of the beverage container to provide a seal.

Figure 4:
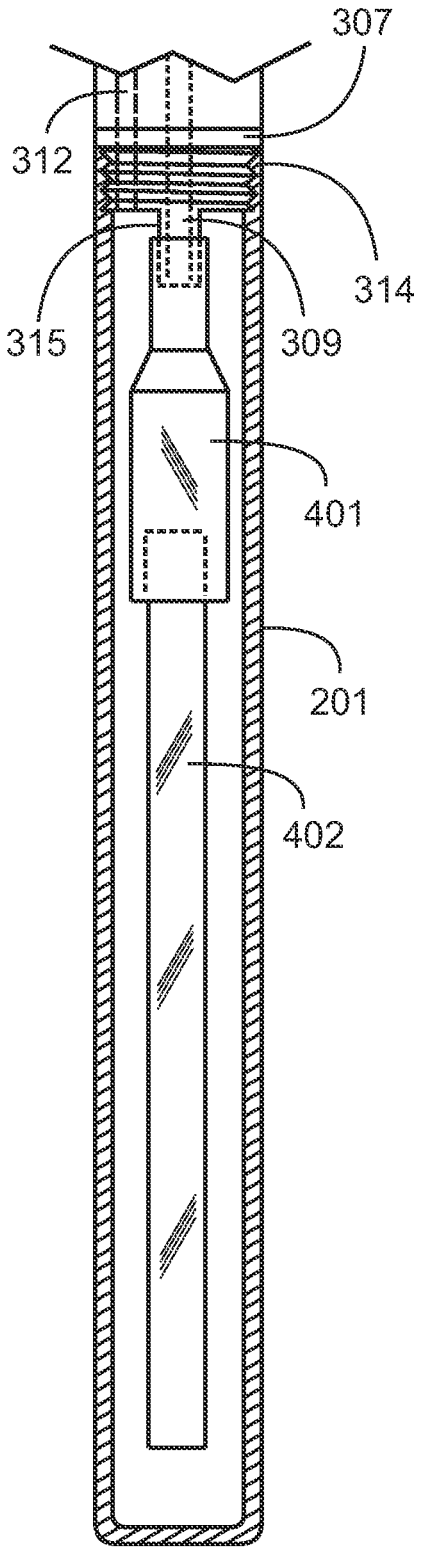
FIG. 4 is an elevation view, in section, of the inner sealed enclosure of FIG. 2.

FIG. 4 is an elevation view, in section, of inner sealed enclosure 201 engaged by internal threads to threads 314 of closure 101. Sealed enclosure 201 fully engaged by threads 314 urges against a gasket 307, also seen in FIG. 3, by which the inner volume of enclosure 201 is isolated from the volume within beverage container 102. In one embodiment of the invention an adapter 401, molder of a flexible polymer, has a circular opening on one end to connect to nib 315, and opening on the opposite end to connect to a vapor-producing apparatus 402, which may be a conventional vape pen of one of several types. When access element 106 is fully rotated to a stop to align opening 304*b* with passage 309 a user may draw on opening 304*a* to ingest vapor from vapor-producing apparatus 402. Passage 312 provides a vent to atmosphere for the volume in enclosure 201 outside the vapor-producing apparatus.

Figure 5:
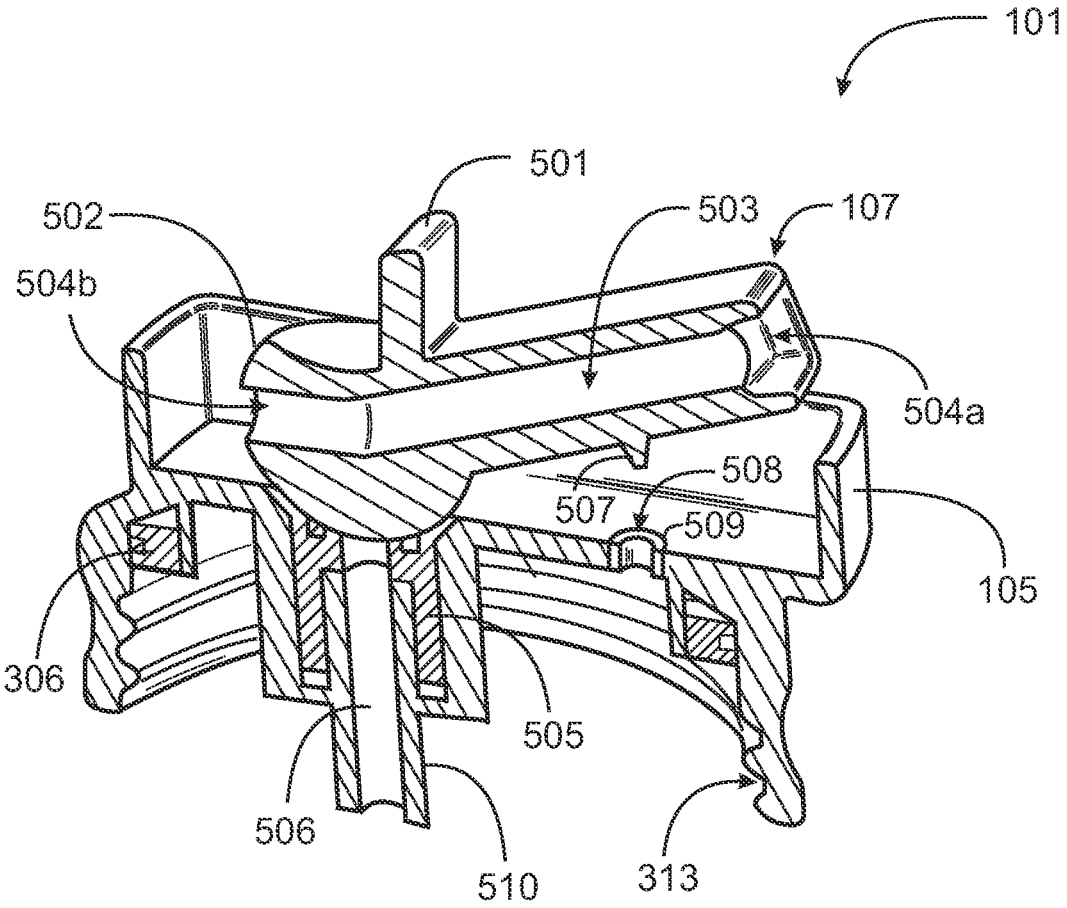
FIG. 5 is a section through the container closure of FIG. 1.

FIG. 5 is a section through closure 101 along a centerline of access element 107 in well 105. Access element 107 differs from access element 106 by the placement of a tip 507 in a position to close a vent opening 508 through a bottom surface of well 105 into the inner volume of beverage container 102. Vent opening 508 has a seal element 509 to secure a good seal when access element 107 is rotated down to close opening 508 by tip 507.

A seal element 505 similar to seal element 307 of FIG. 3 surrounds an opening to passage 506 in a bottom surface of well 105. Access element 107 has a spherically-shaped end 502 the matches a spherical shape of seal element 505 such that access element 107 may be rotated by tip 501 to align opening 504*b* with passage 506. Passage 506 terminates at a nib 510 to which tubing 202 connects, by virtue of tubing 202 being formed of a flexible polymer material. In an alternative embodiment tubing 202 may connect to nib 510 by a flexible tubing adapter piece. With access element 107 fully rotated to a stop and opening 504*b* aligned with passage 506 a user may draw on opening 504*a* to bring liquid up from beverage container 102, through passage 506 and passage 503, into the user's mouth.

It will be apparent to the skilled person that the closure 101 as described above, in concert with inner enclosure 201, adapter 401 and vapor apparatus 402, and tubing 202 may selectively open and close the two separate access elements and access either vapor from vapor apparatus 402 or sips of beverage from beverage container 102.

Figure 6:
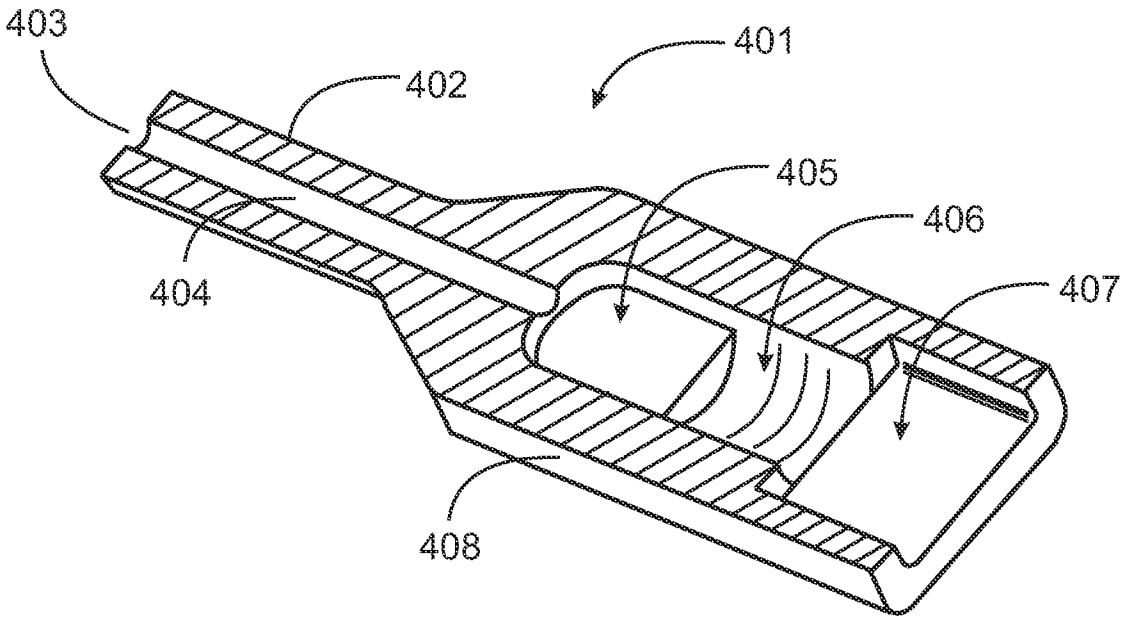
FIG. 6 is a partially sectioned view of an adapter shown in FIG. 4.

FIG. 6 is a partially sectioned view of adapter 401 of FIG. 4, adapted to connect nib 315 and vapor apparatus 402. Region 402 is circular with circular internal passage 404, which is pushed onto nib 315 to connect to passage 309. A wider portion 408 has differently shaped internal regions 405, 406 and 407 to engage tip ends of different vapor-producing apparatus. In the example illustrated by FIG. 4 the engagement is by region 407, as the vapor-producing apparatus of FIG. 4 has a wider and flat aspect. In one embodiment adapter 401 is molded to accommodate and connect to three of the more preferred conventional vapor-producing apparatus.

In the figures and description above closure 101 is illustrated and described as having internal threads to match external threads on an upper extremity of a beverage container. In an alternative embodiment the beverage container may have an internal threaded upper region, and closure may have an externally threaded region to engage the internal threads of the beverage container. In yet another embodiment the closure may be adapted to snap fit on the upper rim of a beverage container having a plain upper rim, like, for example a paper cup.

Figure 7:
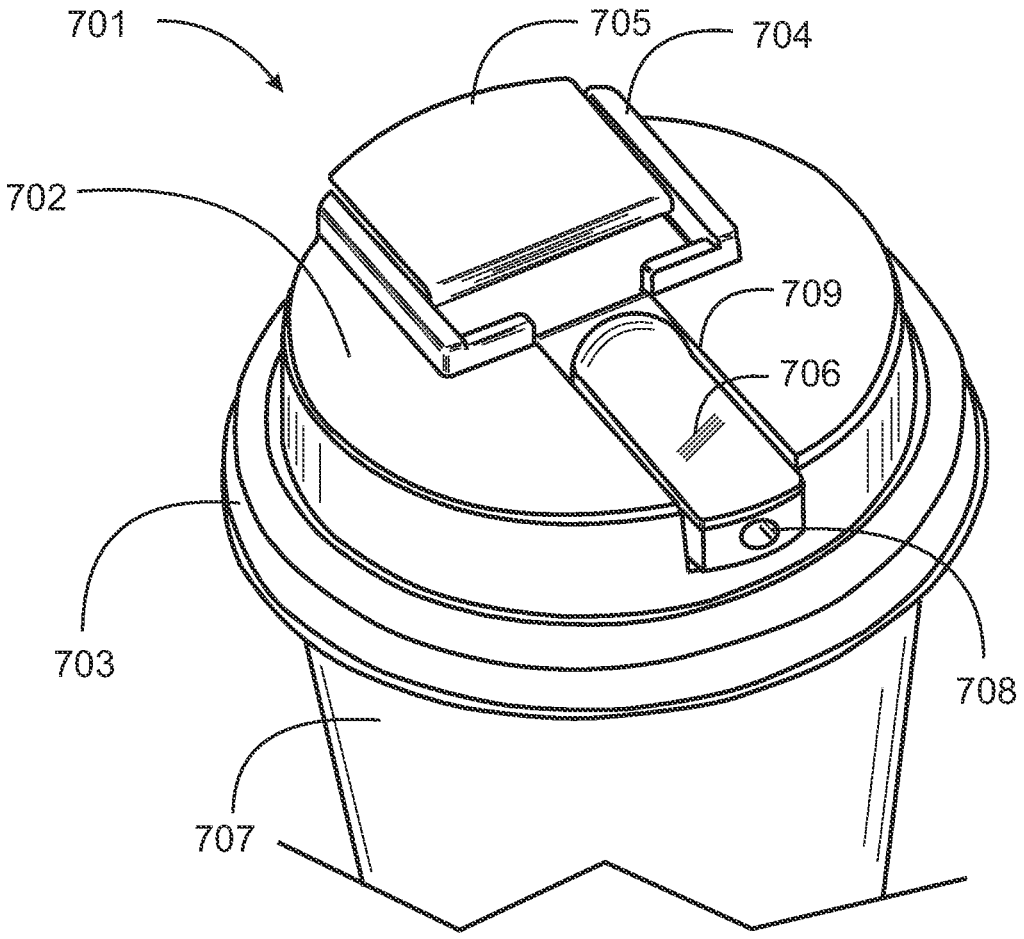
FIG. 7 is a perspective view of a closure for a container in an alternative embodiment of the invention.

FIG. 7 is a perspective view of a closure 701 adapted to snap onto a thin-walled beverage container 707, such as a paper cup, for example. In this example the closure has an upper body 702 that is molded of a polymer material and is substantially rigid. A lower body 703 has a relatively thin wall to allow the lower body some flexibility to engage an upper rim of the beverage container 707. A substantially rectangular well 704 is formed in the upper body, and a pivoted cover 705 engages inner walls of the well. A second well 709 is formed in the upper body and an access element 706 engages inner walls of well 709. Access element 706 is similar to access elements 106 and 107 of FIG. 2, and has an opening 708 to a channel through the length of the access element.

Figure 8:
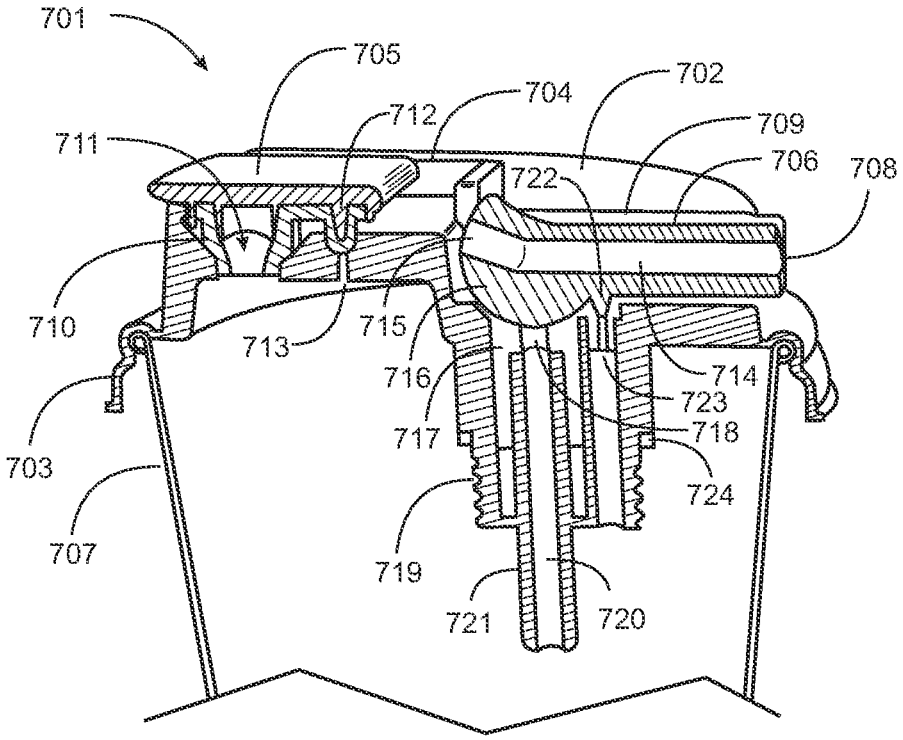
FIG. 8 is a cross section of the closure of FIG. 7.

FIG. 8 is a cross section of closure 701 taken along a centerline that passes lengthwise through both pivoted cover 705 and access element 706. The thin-wall lower body 703 is illustrated as snapping over an upper rim of paper cup 707. In this embodiment there is a gasket seat 710 in a vertical opening through closure body 702 that presents an opening 711 that is closed by a shape of pivoted cover 705 with the pivoted cover in a downward horizontal closed position. When pivoted cover 705 is pivoted upward opening 711 is exposed, and provides an interface for a user to place the lips at the edge of the closure, tilt the beverage container and drink from the container just as a user would an open container. Opening the pivoted cover also opens a vent hole 713 that is closed by tip 712 with the pivoted cover in the closed position.

Access element 706 is pivoted within well 709 just as access elements 106 and 107 in wells 104 and 105, and access element 706 has a spherically-shaped end 716 that mates with a spherical shape of a gasket seat 717, such that access element 706 may be rotated to align opening 715 with opening 718, such that channel 720 is open through opening 718, opening 715, channel 714 and opening 708 to the outside.

In this example male threads 719 are the same as threads 314 shown in FIG. 3, such that an inner enclosure 201 may be engaged by female threads to male threads 719 just as illustrated in FIG. 4, to bear on a gasket 724. Adapter 401 of FIG. 4 may be engaged to nib 721 and to a vapor-producing apparatus 402, just as illustrated in FIG. 4.

Closure 701 is thus a dual-access container closure just as is closure 101. A user may manipulate pivoted cover 705 to drink from the paper cup, and may manipulate access element 706 to draw vapor from a vapor-producing apparatus such as apparatus 402 and others, adapted to the closure by an adapter such as that illustrated in FIG. 6.

A skilled person will understand that the embodiments illustrated in FIGS. 2 and 3 may be adapted to snap onto a paper cup, such as beverage container 707 of FIGS. 7 and 8, as shown in FIG. 8, and also that the embodiment shown in FIG. 8 might also be adapted to have a male or a female thread to engage threads of a beverage container, as described above for the embodiment illustrated by FIGS. 2 and 3.

In yet another embodiment of the invention, referring again to FIG. 2 and to FIG. 4, the adapter 401 and the vapor-producing apparatus may be removed from inside the sealed enclosure 201, and a tubing similar to tubing 202 may by connected to nib 315 to extend down into the interior of the sealed enclosure. In this arrangement one beverage may be introduced into container 102 outside the sealed enclosure 201, and a second, different beverage may be introduced into sealed enclosure 201. In this arrangement the two beverages are completely separated, and do not mix, and a user may draw one beverage from the container outside the sealed enclosure, and a different beverage from inside the sealed enclosure within the beverage container. As a simple example, one may have water in one place and vodka in another and may manipulate the access elements to imbibe one or the other.

In the embodiments described above a container closure provides two separate enclosures in the beverage container and two access mechanisms, one for each of the separate enclosures. See FIGS. 1 and 2 and descriptions in the specification above. In yet another embodiment of the invention a single access container closure is provided in a manner that a user may access the two separate enclosures with a single access mechanism in a single access well.

Figure 9:
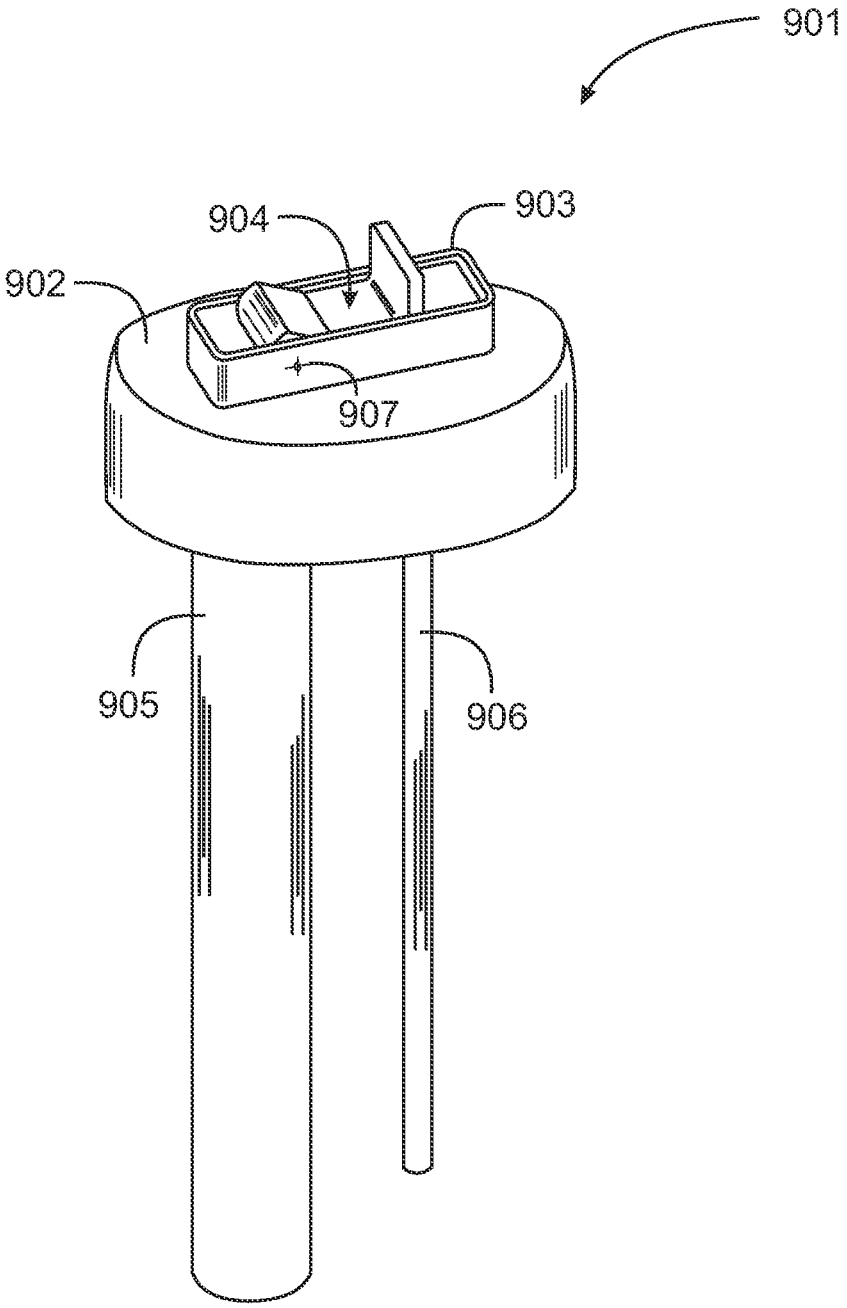
FIG. 9 is a perspective view of a container closure having a single access element for selectively accessing two inner regions of a beverage container.

FIG. 9 illustrates a closure 901 with a threaded body 902 for closing a beverage container. There is a sealed enclosure 905 analogous to sealed enclosure 201 of FIG. 2. There is in addition a tube 906 that communicates directly with the internal volume of the beverage container. Body 902 has a single rectangular access well 903 with one tip-up access element 904, which is pivoted on the sides of the well at point 907. The access well and access element are devised such that a user may selectively access either the internal volume of sealed enclosure 905 or the internal volume of the beverage container.

Figure 10:
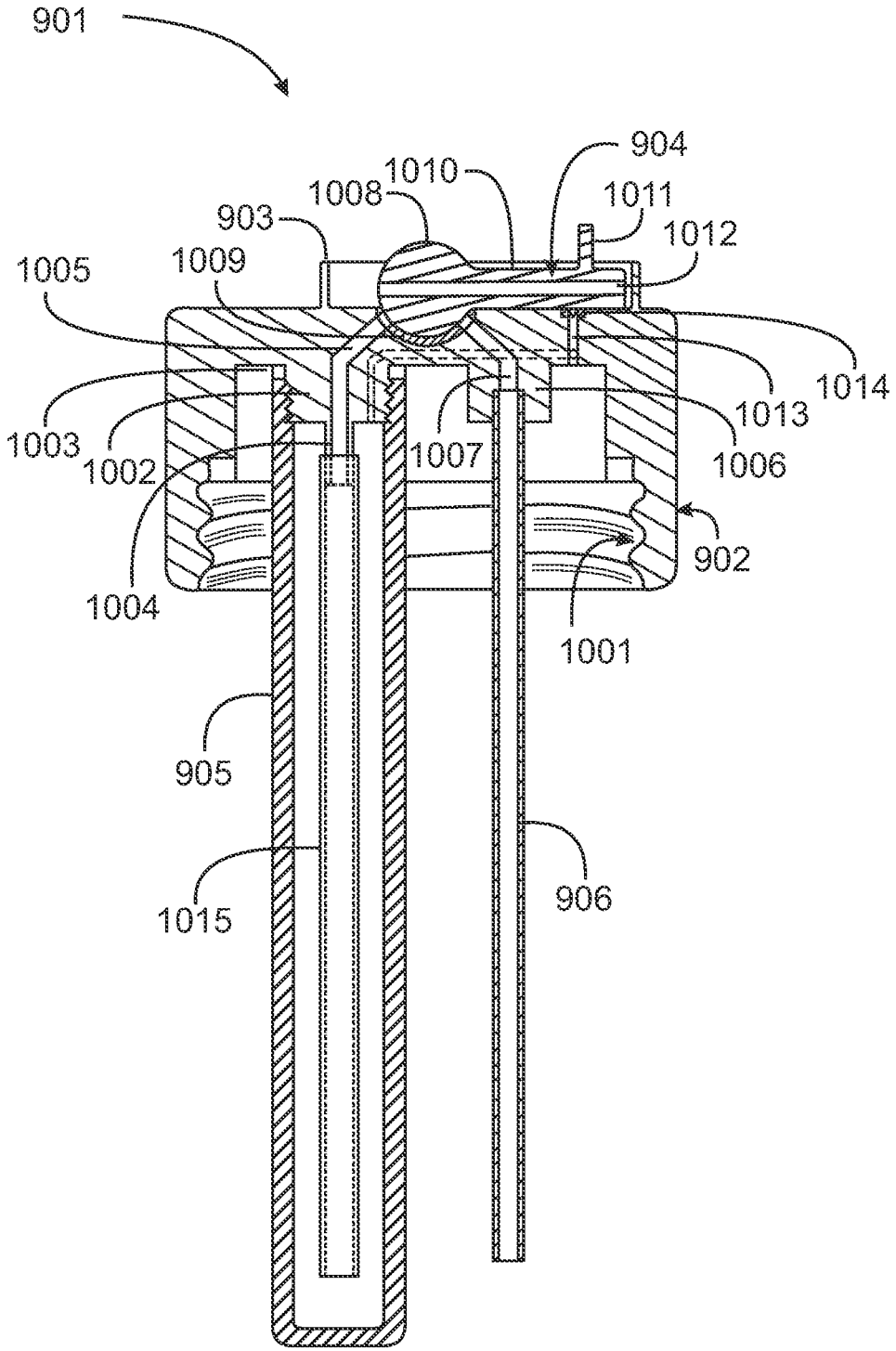
FIG. 10 is an elevation cross section of the container closure of FIG. 9 with the access element rotated to a closed position.

FIG. 10 is a section view of container closure 901 taken on a vertical section plane that passes through the center of body 902, access well 903 and element 904 lengthwise. Body 902 has a female thread 1001 to engage male thread on a beverage container. In this example there is a sealed enclosure 905 that has a female thread on an upper end that engages a male thread on an extension 1002 under body 902. A gasket 1003 at the upper end of extension 1002 seals the inner volume of enclosure 905, and in this example a tube 1015 engages an extension 1004 and opens into the volume of enclosure 905. A tube 906 engages a bore in an extension 1006 and opens into the main volume of the beverage container outside of sealed enclosure 905.

A tip-up access element 904 has a cylindrical end 1008, an extension 1010 and a tab 1011 that is useful for tipping the access element. Cylindrical end 1008 is pivoted across sides of a rectangular well 903 and rests in a cylindrical seat in a bottom of the well, the seat lined by a seal 1009 such that the outside diameter surface of the cylindrical portion of the tip-up element remains sealed to body 902 as the access element is rotated.

Access element 904 has a lengthwise through channel 1012 that extends the full length of the access element. There is a tubular channel 1005 through body 902 and gasket 1009 that leads to tube 1015, and another tubular channel 1007 through body 902 and gasket 1009 that leads to tube 906. A bore 1013 leads from a bottom of access well 903 to the inner volume of the beverage container, with a seal 1014 at the upper end. Tip-up element 904 has a side tip 1016 (FIG. 11) that closes bore 1013 when the tip-up access element 904 is closed in the well as shown in FIG. 10. A side passage of bore 1013 leads to the inner volume of enclosure 905, but is not on the section plane so as to not intersect another bore or passage.

Figure 11:
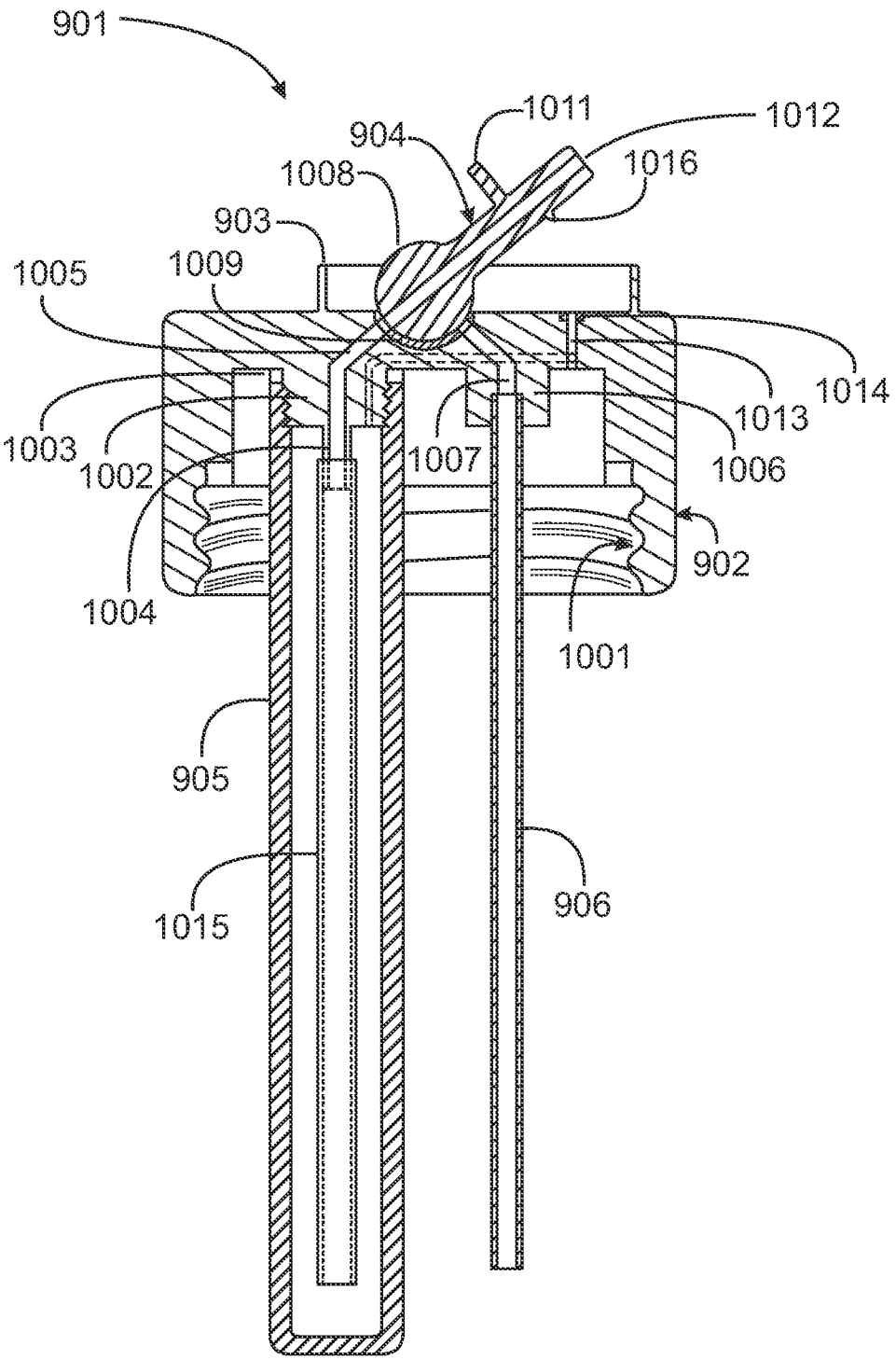
FIG. 11 is the section of FIG. 10 with the access element rotated to access a sealed enclosure.

FIG. 11 illustrates the container closure of FIG. 10 with tip-up element 904 rotated such that through channel 1012 aligns with tubular channel 1005 which communicates with tube 1015. Note that tubular channel 1007 is closed with the access element thus rotated. In this position a user may imbibe a liquid in the internal volume of sealed enclosure 905.

Figure 12:
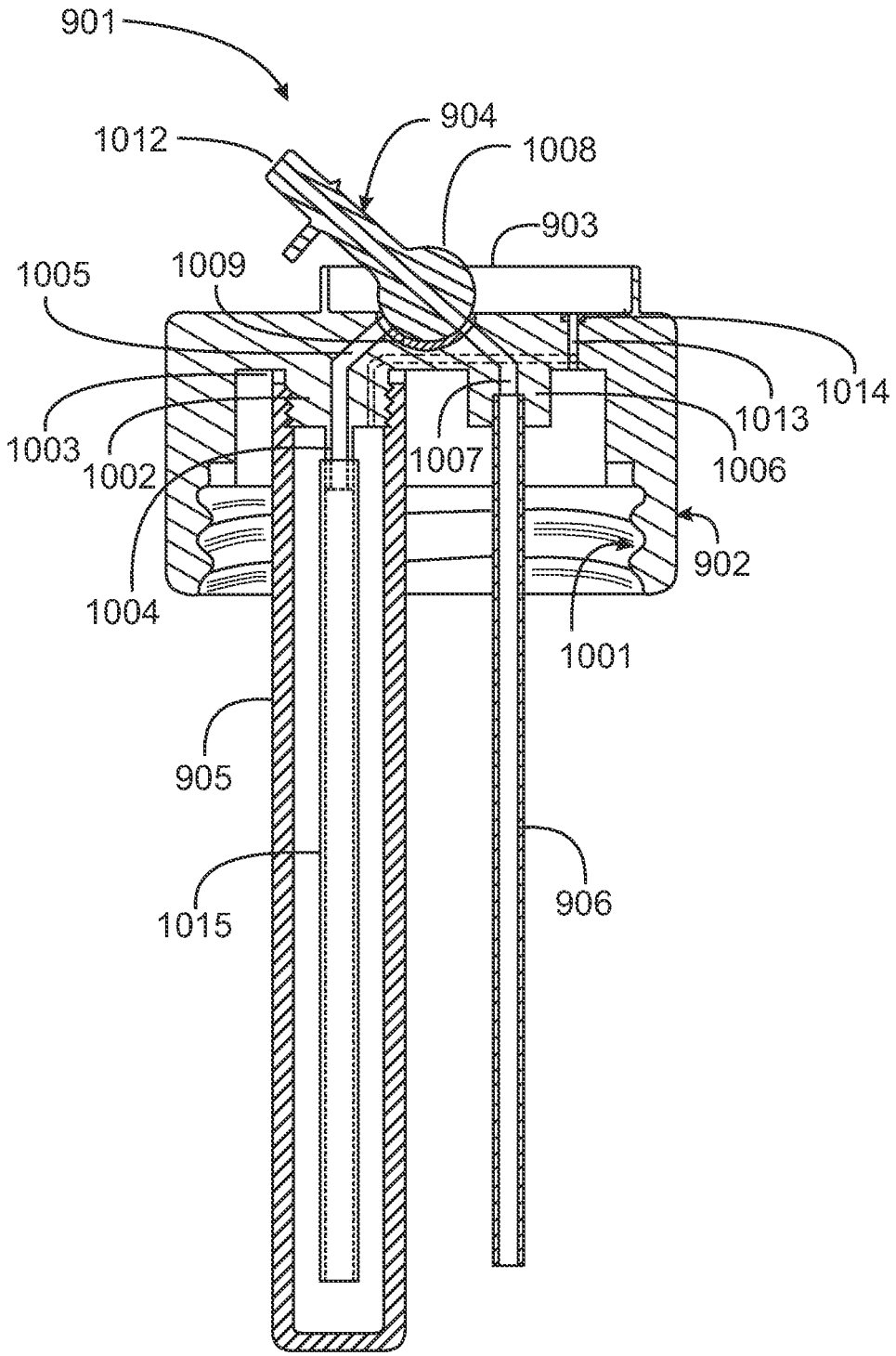
FIG. 12 is the section view of FIG. 10 with the access element rotated to access an inner volume of the beverage container.

FIG. 12 illustrates the container closure of FIG. 10 with tip-up element 904 rotated such that through channel 1012 aligns with tubular bore 1007 which communicates with the inner volume of the beverage container. In this position a user may imbibe a beverage in the inner volume of the beverage container. Given the description of FIGS. 11 and 12 it will be apparent that in this example a user may have two different beverages and access each by choice.

Figure 13:
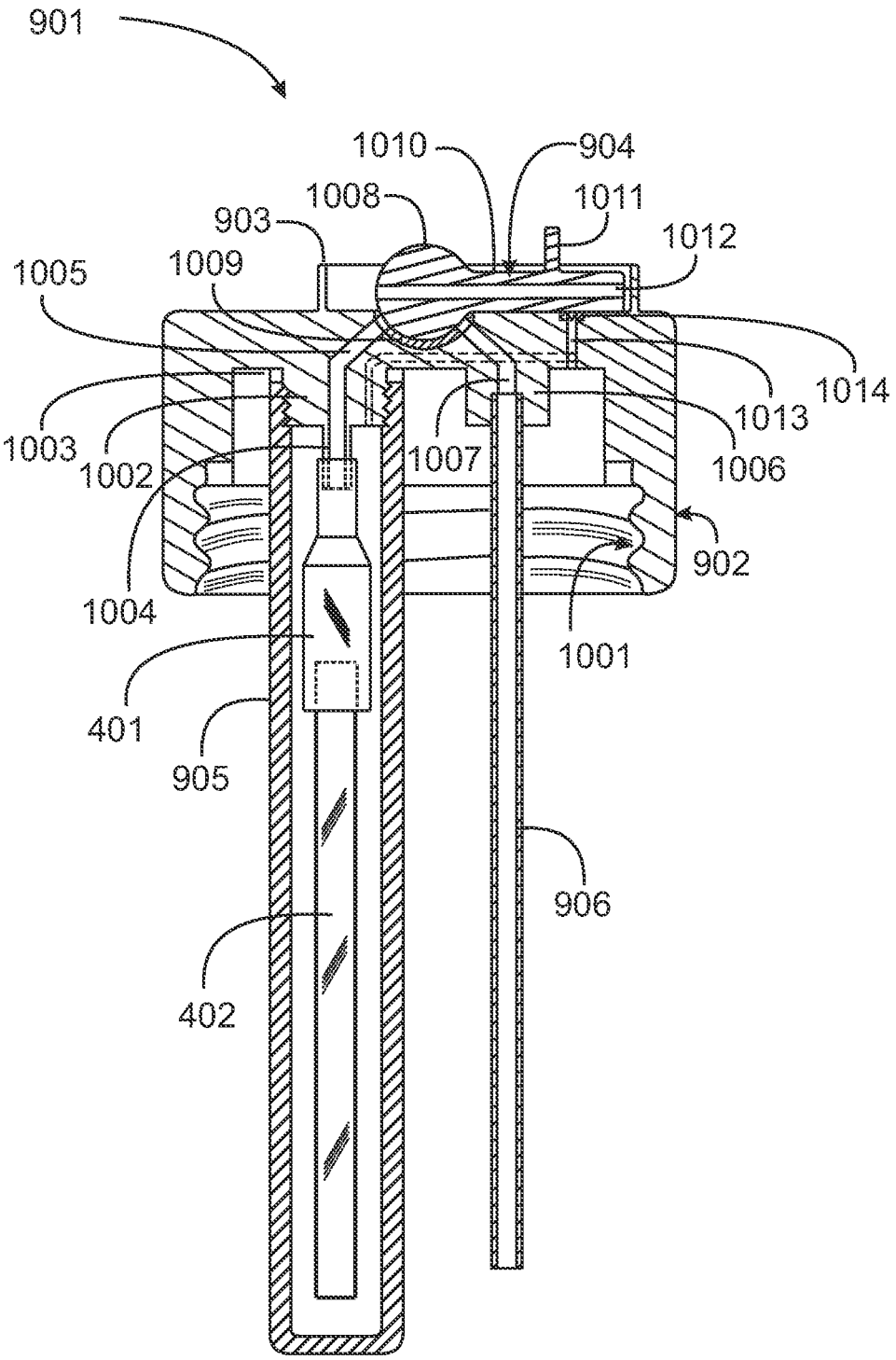
FIG. 13 is the section view of FIG. 10 with the access element rotated closed and with a vapor producing apparatus in the sealed enclosure.

FIG. 13 illustrates the closure of FIG. 10 with tube 1015 removed and a vape pen 402 engaged with a flexible adapter 401 which in turn engages extension 1004 from the underside of the body, all within sealed enclosure 905. Description of adapter 401 and vape pens is provided above as well. In the example of FIG. 13 access element 904 is shown in the closed position in well 903 with channel 1013 sealed.

Figure 14:
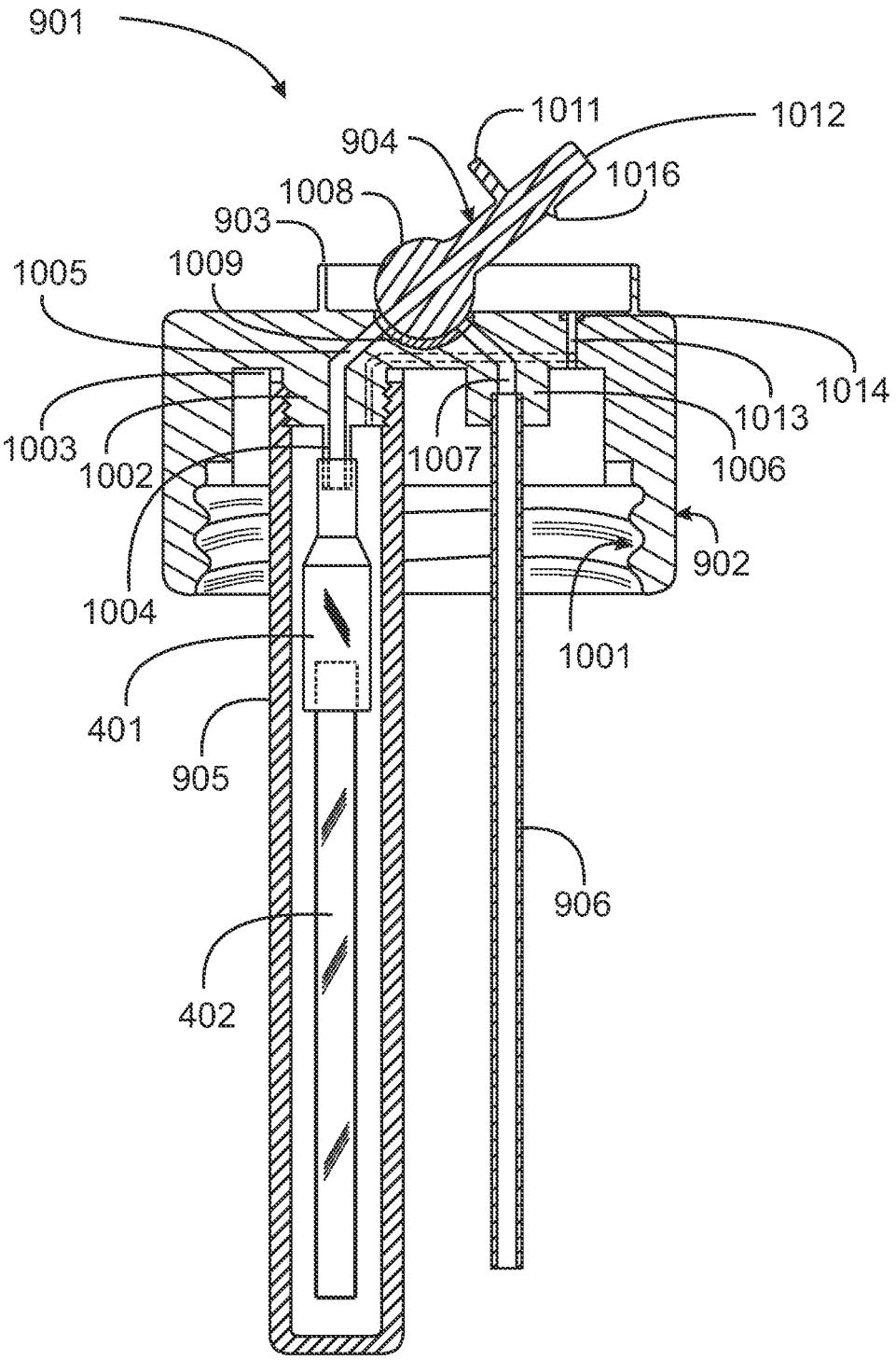
FIG. 14 is the section view of FIG. 13 with the access element rotated to access the vapor producing apparatus in the sealed enclosure.

FIG. 14 illustrates the closure of FIG. 13 with access element 904 rotated to a position to align channel 1012 with tubular channel 1005 enabling the user to draw on vape pen 402. In this position channel 1013 is open venting the inner volume of sealed enclosure 905.

Figure 15:
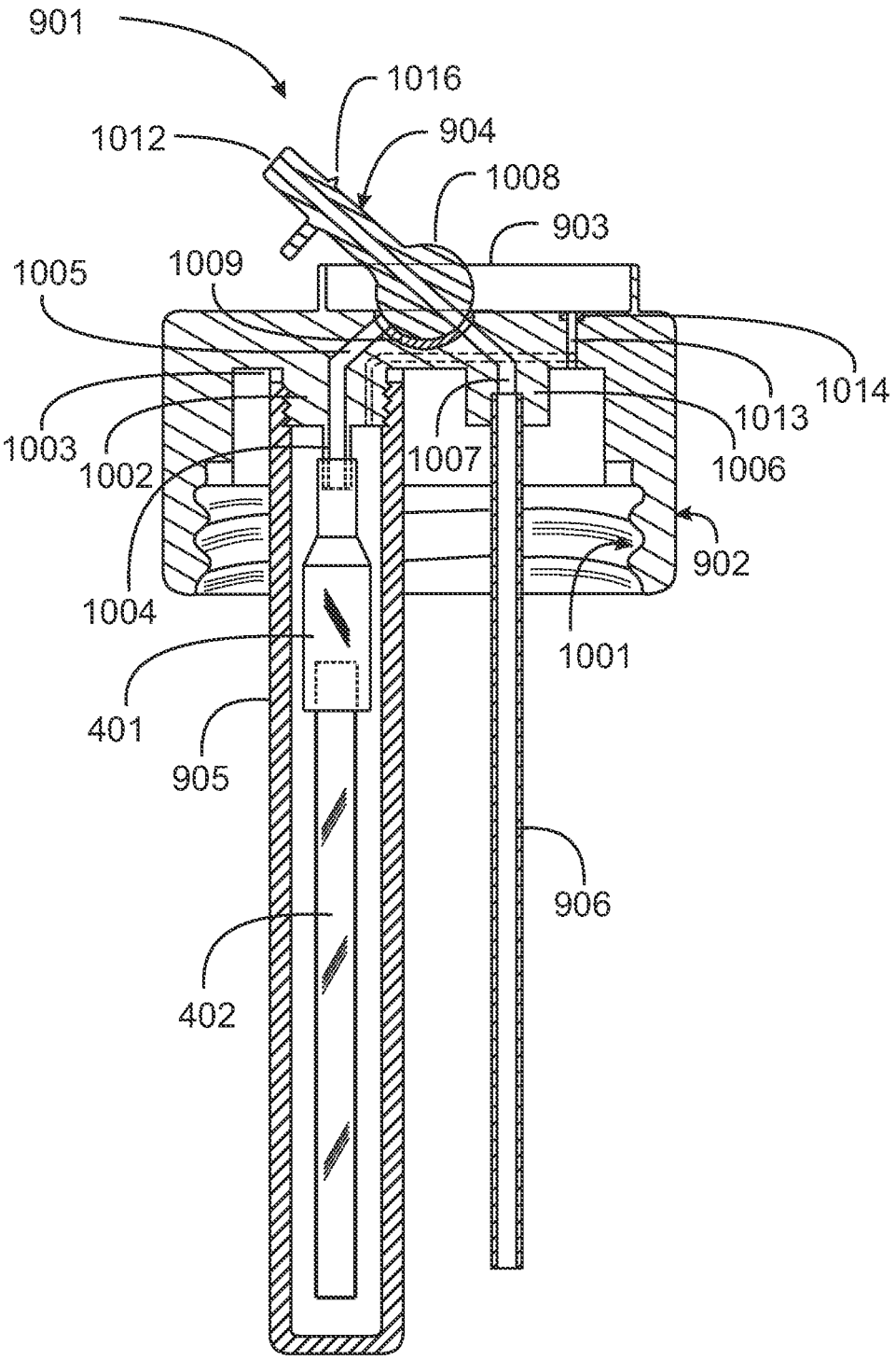
FIG. 15 is the section view of FIG. 13 with the access element rotated to access the inner volume of the beverage container.

FIG. 15 illustrates the closure of FIG. 13 with the access element 904 rotated to position to align channel 1012 with tubular channel 1007 enabling the user to imbibe a liquid from the beverage container. Again, channel 1013 is open at this position providing vent to the beverage container.

Figure 16B:
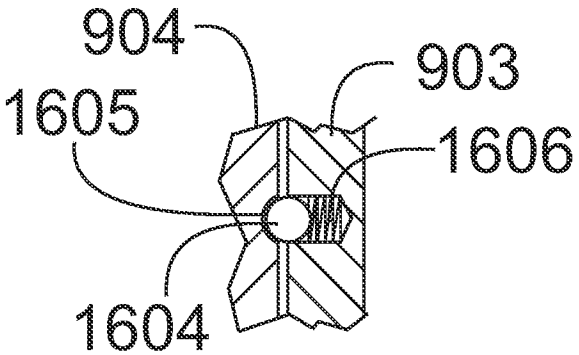
FIG. 16B illustrates a spring-loaded ball positioning the access element.
Figure 16A:
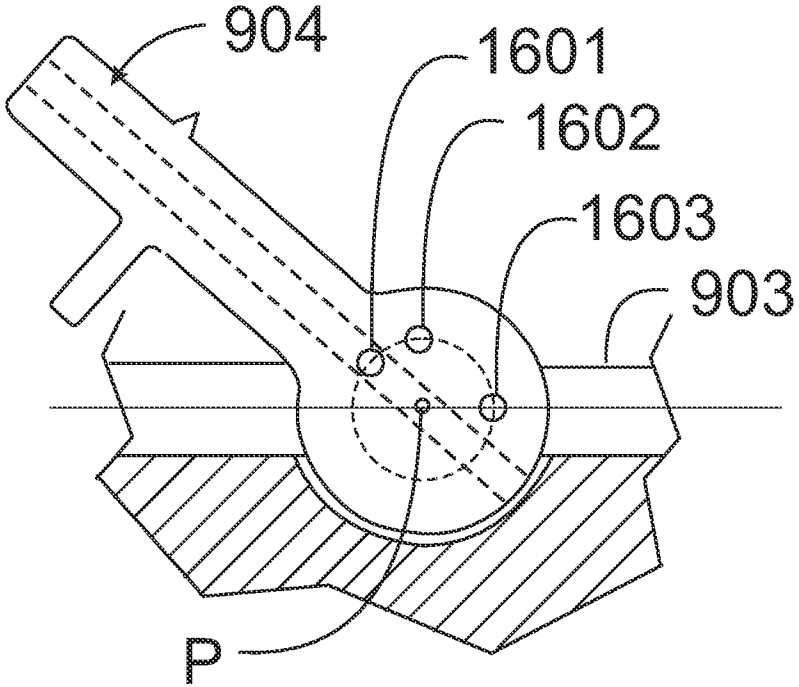
FIG. 16A is an elevation view of the access element with depressions for positioning.

In embodiments of the invention described here mechanisms are provided for aiding the user in positioning access element 904 rotationally. FIG. 16A is a partial cutaway elevation view of access element 904 pivoted across sides of well 903 at a point P which is the center point of the spherical portion 1008 of the access element. In this example there are three small 1601, 1602 and 1603 spherical indentions on a radius from the pivot point on one side of the access element to position the access element rotationally at three different positions, as are indicated in FIGS. 10-15. FIG. 16B illustrates a cutout section showing one indention 1605 in access element 904 engaging a ball 1604 urges by a spring 106 in a bore in one side of well 903. Ball 1605 engages each of the three indentions 1601, 1602 and 1603 to accurately position the access element for alignment of channel 1202 with other channels.

A skilled person will understand that the embodiments and examples presented and described above are all exemplary, and not limiting to the invention. Embodiments of the invention may incorporate features described an several variations. The scope of the invention is limited only by the claims.

The invention claimed is:

1. A closure for a beverage container, comprising:

a body having an attachment interface to engage to a top of a beverage container;

a sealed, elongated enclosure attached to an underside of the body; and a single tip-up access element adapted to selectively open and close either a first opening passing through the body into the sealed, elongated enclosure or a second opening passing through the body directly to an inner volume of the beverage container, by a movement of the single tip-up access element.

2. The closure of claim 1 wherein the attachment interface of the body is a male thread matching a female thread at the top of the beverage container.

3. The closure of claim 1 wherein the single tip-up access element is an elongated element having a cylindrical portion at a first end and an extended portion from the cylindrical portion with a passage through a length of the element, the cylindrical portion pivoted at a center point of the cylinder between opposite sides of an elongated well on an upper region of the body, in a manner that with the single tip-up access element in a first position lying in the elongated well with the cylindrical portion engaging a cylindrically shaped depression the single tip-up access element seals a vent into both the beverage container and the sealed enclosure, with the single tip-up access element rotated to a second position aligns the passage through the length of the single tip-up access element with an opening through the body into the sealed enclosure and with the single tip-up access element rotated to a third position aligns the passage through the length with an opening through the body into an inner volume of the beverage container.

4. The closure of claim 1 wherein the first opening passing through the body into the sealed elongated enclosure ends at a first interface under the body with a first tube engaged reaching proximate the lower end of the sealed elongated enclosure, and the second opening passing through the body ends at a second interface with a second tube engaged reaching proximate a bottom of the beverage container.

5. The closure of claim 1 wherein the first opening passing through the body into the sealed elongated enclosure ends at a first interface under the body with a flexible connector engaged to the first interface and to a vapor-producing apparatus and the second opening passing through the body ends at a second interface with a tube engaged reaching proximate a bottom of the beverage container.

6. The closure of claim 1 wherein the attachment interface of the body is a female thread matching a male thread at the top of the beverage container.

7. The closure of claim 1 wherein the attachment interface of the body is a male female thread matching a female male thread at the top of the beverage container.

8. The closure of claim 3 wherein the single tip-up access element has three spherical depressions on one side on a radial ring and a spring-loaded ball on a surface of an inside wall of the rectangular well, such that the ball engages the depressions as the single tip-up access element rotates and positions the single tip-up access element accurately at the first, the second and the third position.

* * * * *